US012392099B1

(12) United States Patent
Schluessel

(10) Patent No.: US 12,392,099 B1
(45) Date of Patent: Aug. 19, 2025

(54) OVERFLOW RESISTANT ARTICULATING PUSHER SHOVEL

(71) Applicant: George Schluessel, Edmonton (CA)

(72) Inventor: George Schluessel, Edmonton (CA)

( * ) Notice: Subject to any disclaimer, the term of this patent is extended or adjusted under 35 U.S.C. 154(b) by 0 days.

(21) Appl. No.: 18/412,521

(22) Filed: Jan. 13, 2024

(51) Int. Cl.
*E01H 5/02* (2006.01)
*E01H 1/12* (2006.01)

(52) U.S. Cl.
CPC *E01H 5/02* (2013.01); *E01H 1/12* (2013.01)

(58) Field of Classification Search
CPC ..... E01H 5/02; A01B 1/222; A01B 1/225
USPC ..... 294/54.5, 53.5, 56
See application file for complete search history.

(56) References Cited

U.S. PATENT DOCUMENTS 841,848 A * 1/1907 Conner
881,782 A * 3/1908 Elliott
3,115,359 A * 12/1963 Hendrick ..... A01B 1/04 294/131
3,473,838 A * 10/1969 Rankin ..... E01H 5/02 294/53.5
3,483,643 A * 12/1969 Wenzel ..... E01H 5/02 15/236.01
4,597,204 A * 7/1986 Heiden ..... E01H 5/02 37/285
5,669,163 A * 9/1997 Winter ..... E01H 5/02 37/284
5,984,393 A * 11/1999 Washington ..... A01B 1/02 294/54.5
7,305,779 B1 * 12/2007 Purvis ..... E01H 5/02 37/285
2008/0185857 A1 * 8/2008 Westgarde ..... E01H 5/02 294/54.5
2013/0119684 A1 * 5/2013 Ceja ..... E01H 5/02 294/56

FOREIGN PATENT DOCUMENTS

KR 20160046353 A * 4/2016

* cited by examiner

*Primary Examiner* — Douglas A Hess
(74) *Attorney, Agent, or Firm* — Womble Bond Dickinson (US) LLP

(57) ABSTRACT

The overflow resistant articulating pusher shovel may allow a user to clear material while preventing overflow from the shovel head and reducing the lifting strain placed upon the user. To reduce or prevent material overflow from the shovel head the device may comprise a shovel head endplate. To eliminate user lifting and straining under load the device may comprise an articulating head that allows a user to push materials in a desired direction instead of lifting that material. The overflow resistant articulating pusher shovel may further comprise a novel articulating mechanism for locking the shovel head into place but also allowing for the head to be articulated. Finally, the overflow resistant articulating pusher shovel may comprise any known advantages in the art, such as handles, shafts, and wear bars, so as to provide for additional ease of use and improved functionality.

1 Claim, 12 Drawing Sheets

OVERFLOW RESISTANT ARTICULATING PUSHER SHOVEL

TECHNICAL FIELD OF THE INVENTION

The present invention relates in general to shovels and, more specifically, to an overflow resistant articulating pusher shovel.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Conventional shovels have been utilized for generations as fundamental tools for digging, lifting, and moving materials. Traditional shovel designs typically comprise a blade or scoop attached to a handle, facilitating the manual transfer of materials from one location to another. While these traditional designs have proven effective in many applications, they often present challenges related to user fatigue, inefficient material handling, and limitations in adaptability to different types of materials.

Existing attempts to address these challenges have led to the development of ergonomic handles, lightweight materials, and variations in blade shapes. However, there remains a need for an innovative shovel design that not only enhances ergonomic considerations but also provides improved maneuverability, durability, and adaptability to diverse snow conditions.

Major shortcomings in the shovel art present themselves when pushing materials with the intention of clearing a pathway through such materials. Sand, mud, or snow, for example, can build up on a pathway and prevent its use. Such materials must then be cleared so that a user can traverse the pathway. One issue that arises when such a task is undertaken is that the material being cleared overflows the shovel head and creates a ridge of such material in the wake of the user's path, which then must be cleared again.

Another issue known in the shovel art is that the repetitive action of pushing, lifting, and tossing material causes excessive user fatigue. While pushing a shovel alone may not present an extreme activity, the act of breaking through built-up material and then lifting and tossing such material can present an undesirable amount of strain on a user's back, shoulders, and core.

Thus, there is a need in the art for an overflow resistant articulating pusher shovel that may allow a user to clear material while preventing overflow from the shovel head and reducing the lifting strain placed upon the user. To reduce or prevent material overflow from the shovel head the device may comprise a shovel head endplate. To eliminate user lifting and straining under load the device may comprise an articulating head that allows a user to push materials in a desired direction instead of lifting that material. The overflow resistant articulating pusher shovel may further comprise a novel articulating mechanism for locking the shovel head into place but also allowing for the head to be articulated. Finally, the overflow resistant articulating pusher shovel may comprise any known advantages in the art, such as handles, shafts, and wear bars, so as to provide for additional ease of use and improved functionality. It is to these ends that the present invention has been developed.

BRIEF SUMMARY OF THE INVENTION

To minimize the limitations in the prior art, and to minimize other limitations that will be apparent upon reading and understanding the present specification, the present invention describes an overflow resistant articulating pusher shovel.

It is an objective of the present invention to provide an overflow resistant articulating pusher shovel that may comprise a shovel.

It is another objective of the present invention to provide an overflow resistant articulating pusher shovel that may comprise a snow shovel.

It is another objective of the present invention to provide an overflow resistant articulating pusher shovel that may comprise a main body.

It is another objective of the present invention to provide an overflow resistant articulating pusher shovel that may comprise an articulating mechanism.

It is another objective of the present invention to provide an overflow resistant articulating pusher shovel that may comprise a head.

It is another objective of the present invention to provide an overflow resistant articulating pusher shovel that may comprise an atlas.

It is another objective of the present invention to provide an overflow resistant articulating pusher shovel that may comprise a shaft.

It is another objective of the present invention to provide an overflow resistant articulating pusher shovel that may comprise a handle.

It is another objective of the present invention to provide an overflow resistant articulating pusher shovel that may comprise an end plate.

It is another objective of the present invention to provide an overflow resistant articulating pusher shovel that may comprise a plurality of wear bars.

It is another objective of the present invention to provide an overflow resistant articulating pusher shovel that may comprise a pivot.

It is another objective of the present invention to provide an overflow resistant articulating pusher shovel that may comprise a locking pin.

It is another objective of the present invention to provide an overflow resistant articulating pusher shovel that may comprise a cord.

It is another objective of the present invention to provide an overflow resistant articulating pusher shovel that may comprise a slide.

It is another objective of the present invention to provide an overflow resistant articulating pusher shovel that may comprise a pivot cavity.

It is another objective of the present invention to provide an overflow resistant articulating pusher shovel that may comprise a pin receiver.

It is another objective of the present invention to provide an overflow resistant articulating pusher shovel that may comprise a resilient material of construction.

It is another objective of the present invention to provide an overflow resistant articulating pusher shovel that may comprise a water-proof material of construction.

It is another objective of the present invention to provide an overflow resistant articulating pusher shovel that may comprise a reusable material of construction.

It is another objective of the present invention to provide an overflow resistant articulating pusher shovel that may comprise a washable material of construction.

It is another objective of the present invention to provide an overflow resistant articulating pusher shovel that may comprise a multi-component construction.

It is another objective of the present invention to provide an overflow resistant articulating pusher shovel that may comprise an antimicrobial layer.

It is another objective of the present invention to provide an overflow resistant articulating pusher shovel that may comprise an antimicrobial material of construction.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

DETAILED DESCRIPTION OF THE INVENTION

Figure 1:
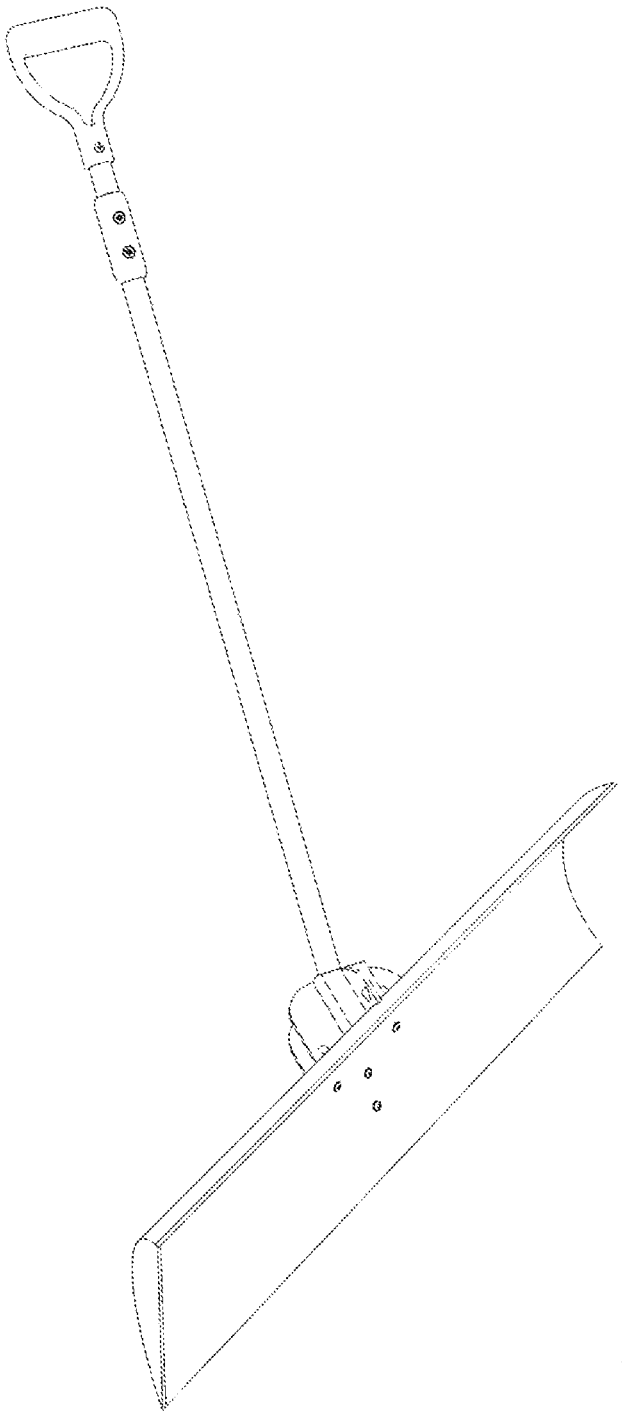
FIG. 1 is a front isometric perspective view of an overflow resistant articulating pusher shovel, as contemplated by the present disclosure.
Figure 2:
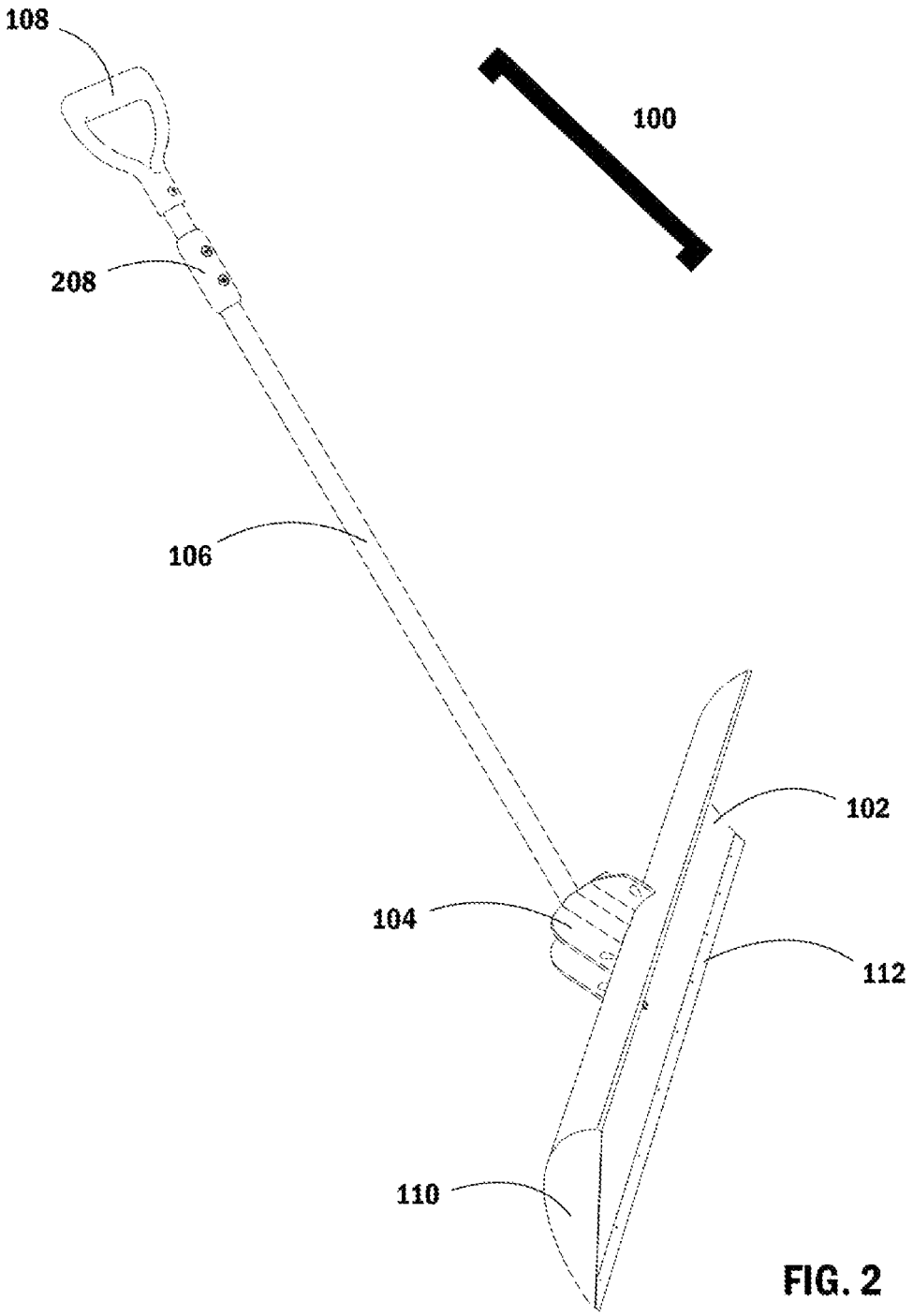
FIG. 2 is a front isometric perspective view of an overflow resistant articulating pusher shovel, as contemplated by the present disclosure.
Figure 3:
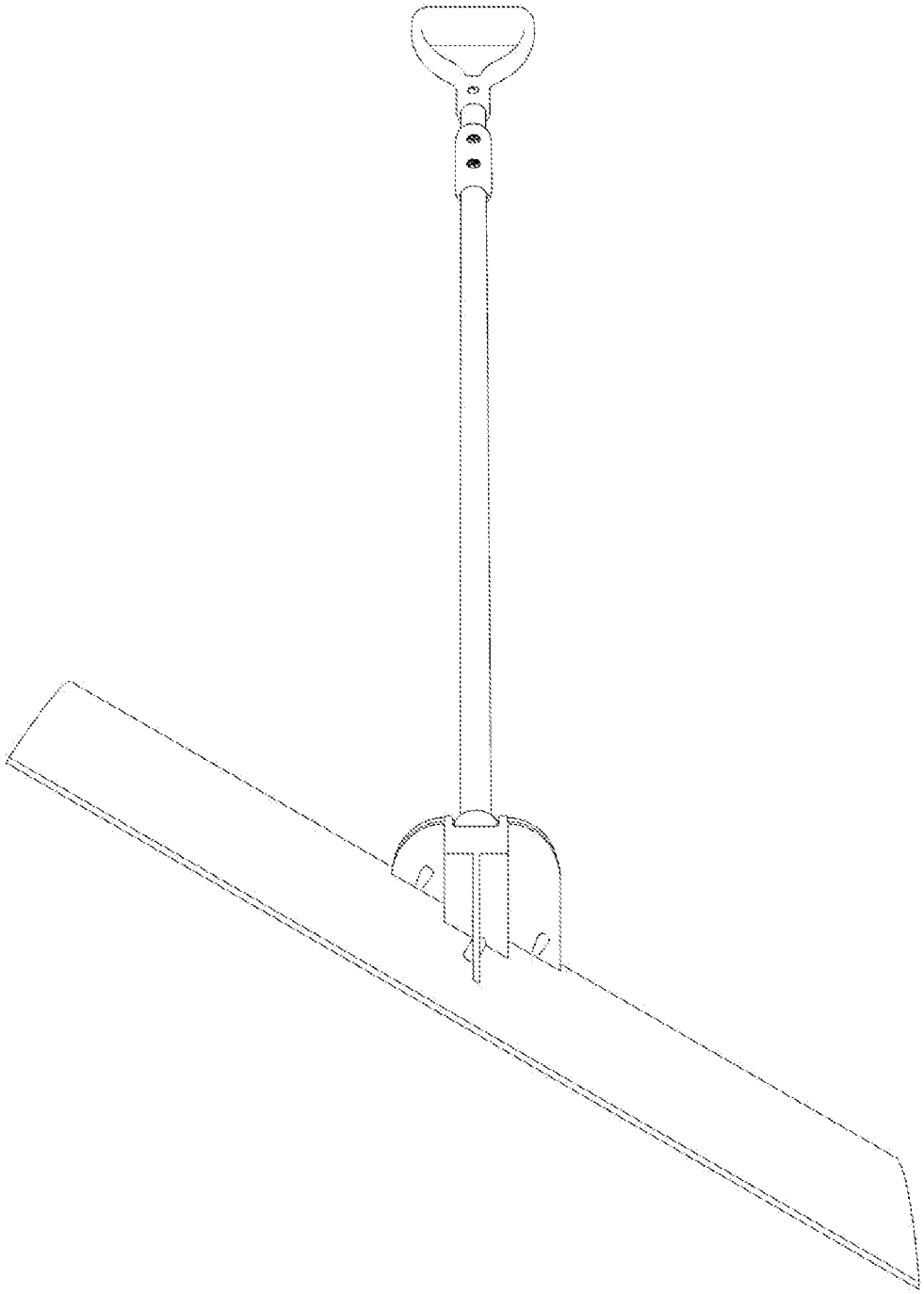
FIG. 3 is a top elevation view of an overflow resistant articulating pusher shovel, as contemplated by the present disclosure.
Figure 4:
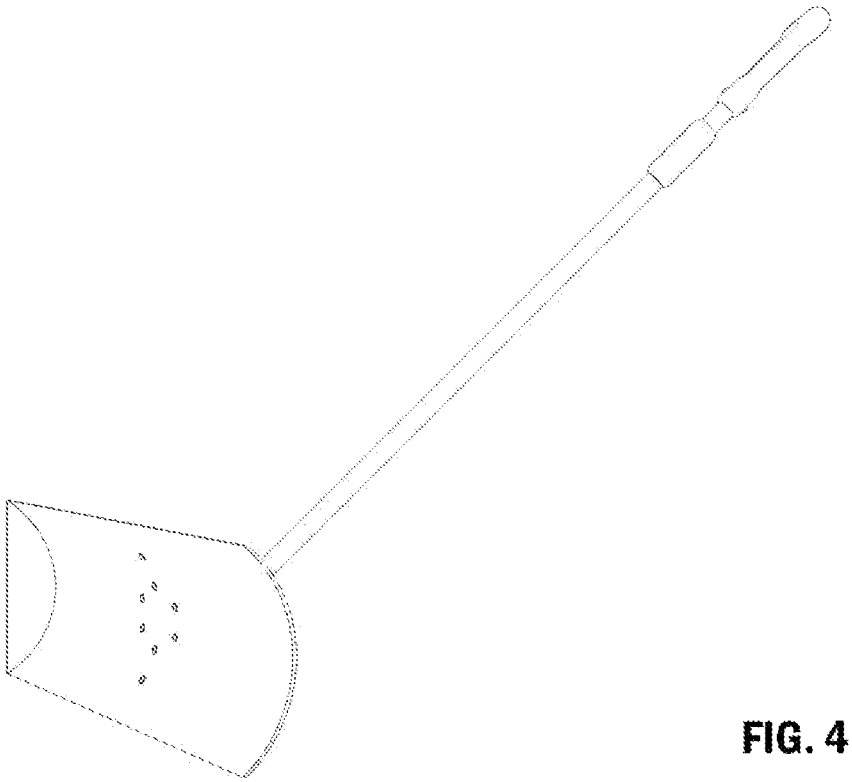
FIG. 4 is a left side elevation view of an overflow resistant articulating pusher shovel, as contemplated by the present disclosure.
Figure 5:
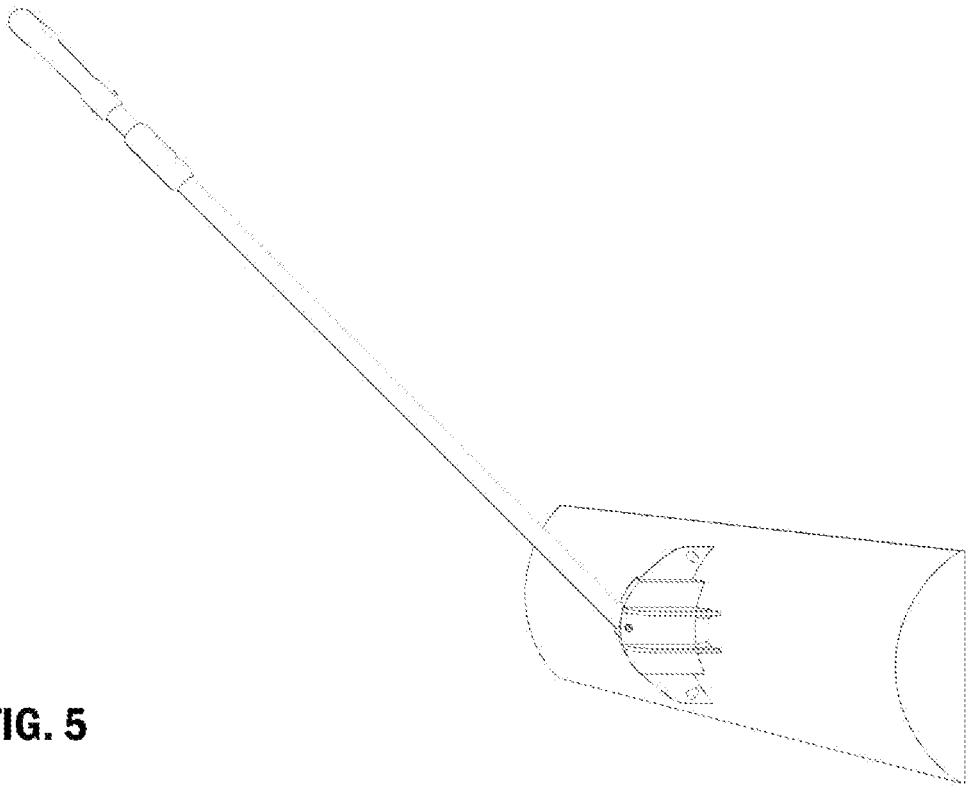
FIG. 5 is a right side elevation view of an overflow resistant articulating pusher shovel, as contemplated by the present disclosure.
Figure 6:
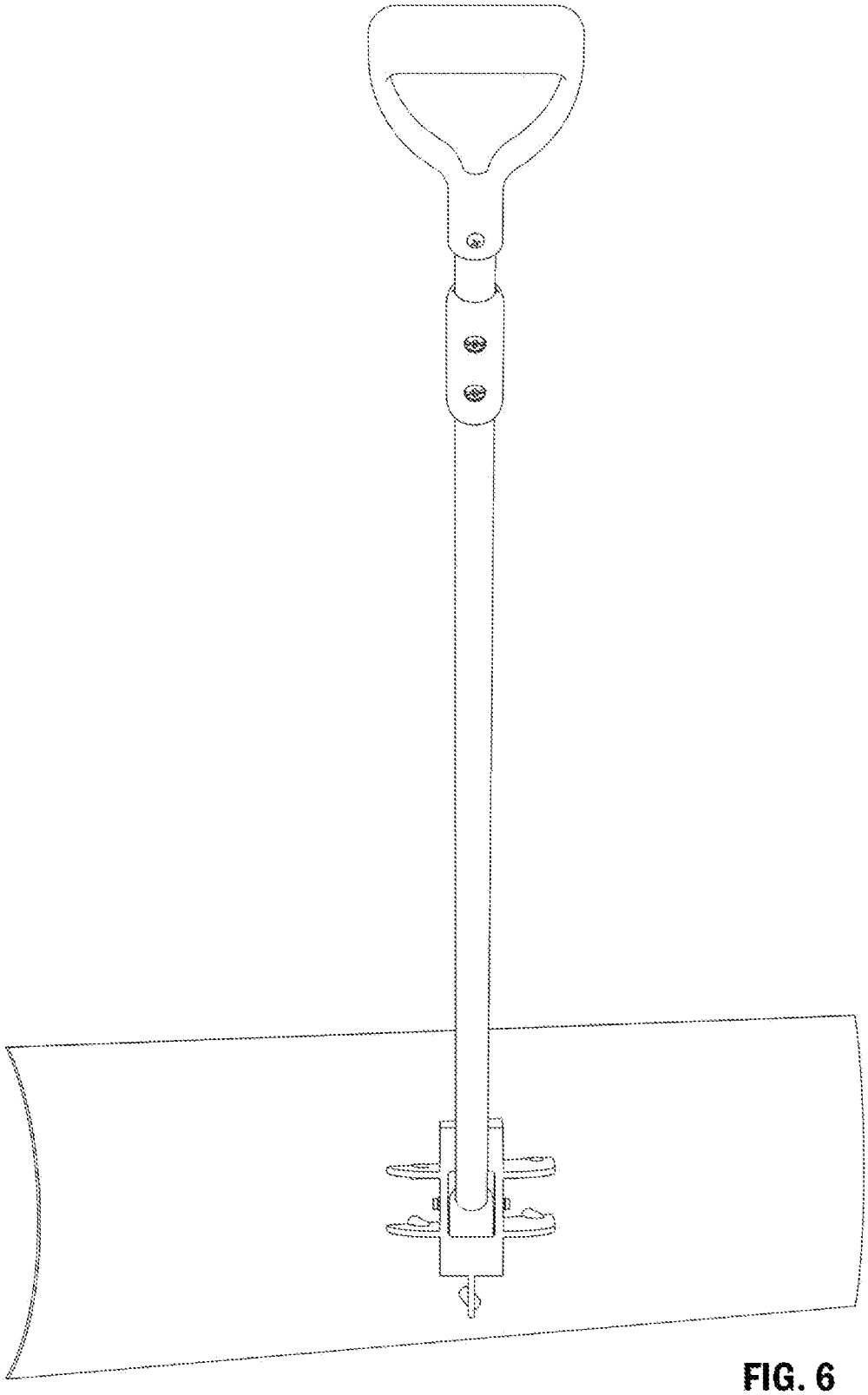
FIG. 6 is a rear elevation view of an overflow resistant articulating pusher shovel, as contemplated by the present disclosure.
Figure 7:
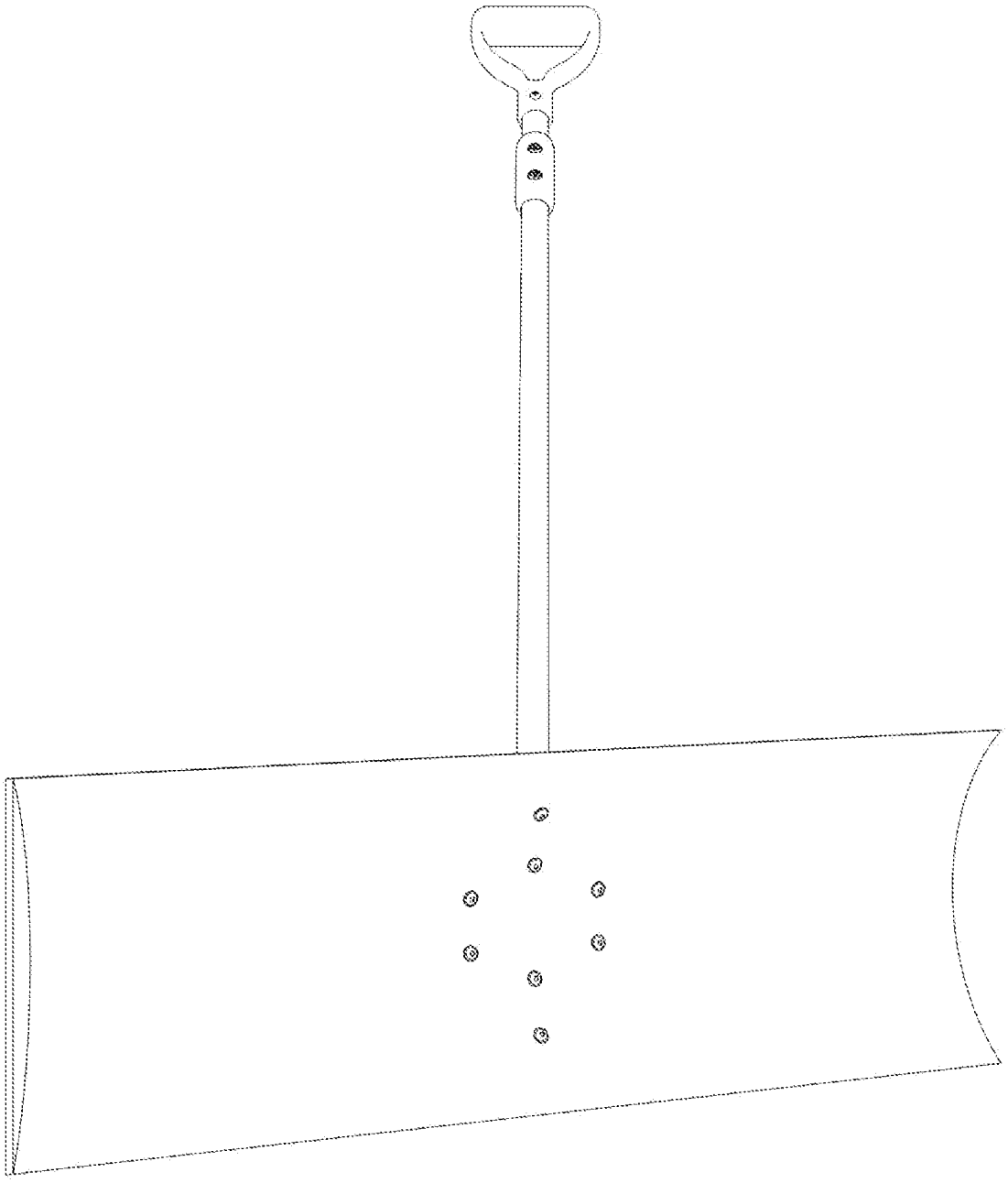
FIG. 7 is a front elevation view of an overflow resistant articulating pusher shovel, as contemplated by the present disclosure.
Figure 8:
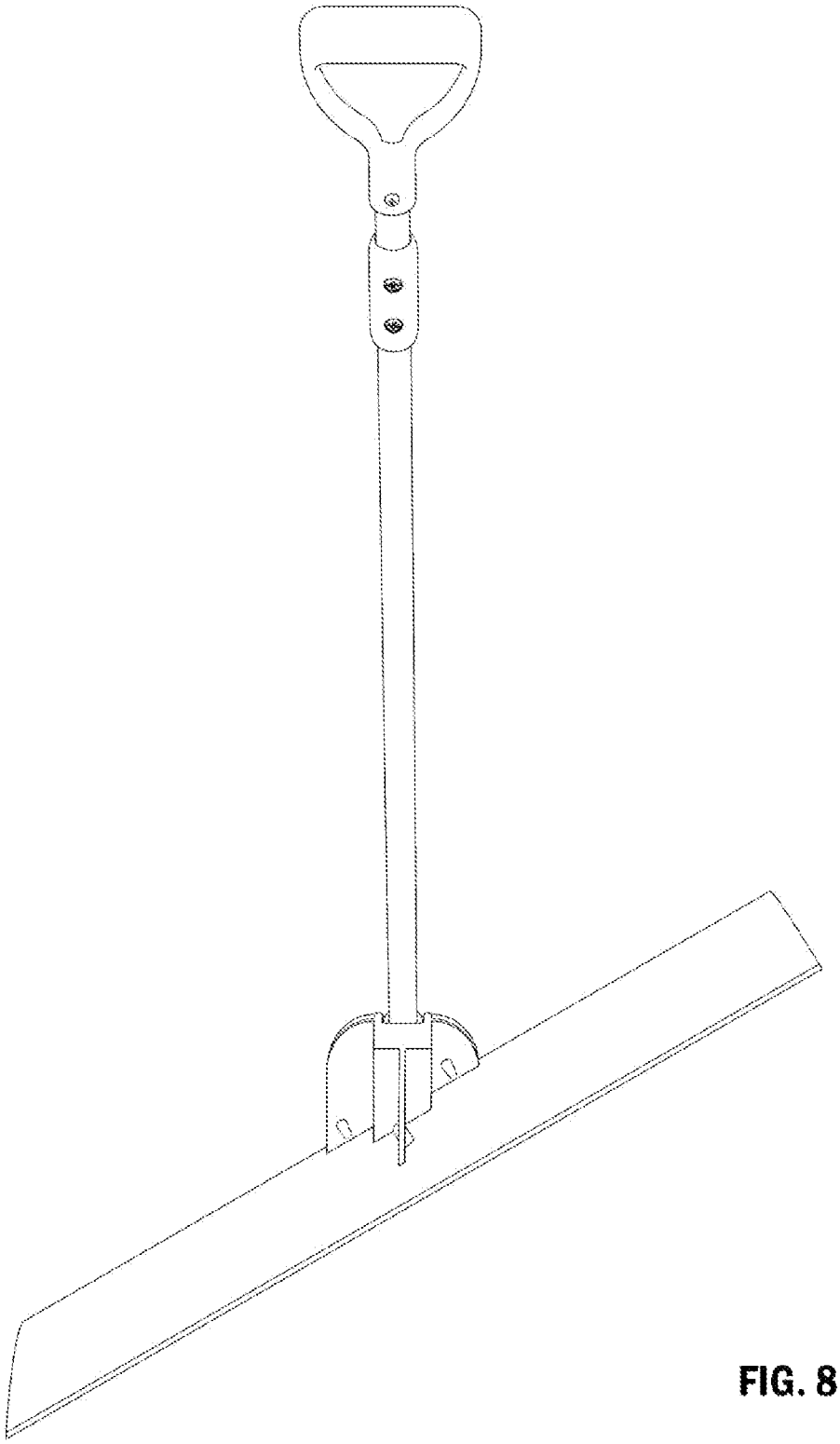
FIG. 8 is a bottom elevation view of an overflow resistant articulating pusher shovel, as contemplated by the present disclosure.
Figure 9:
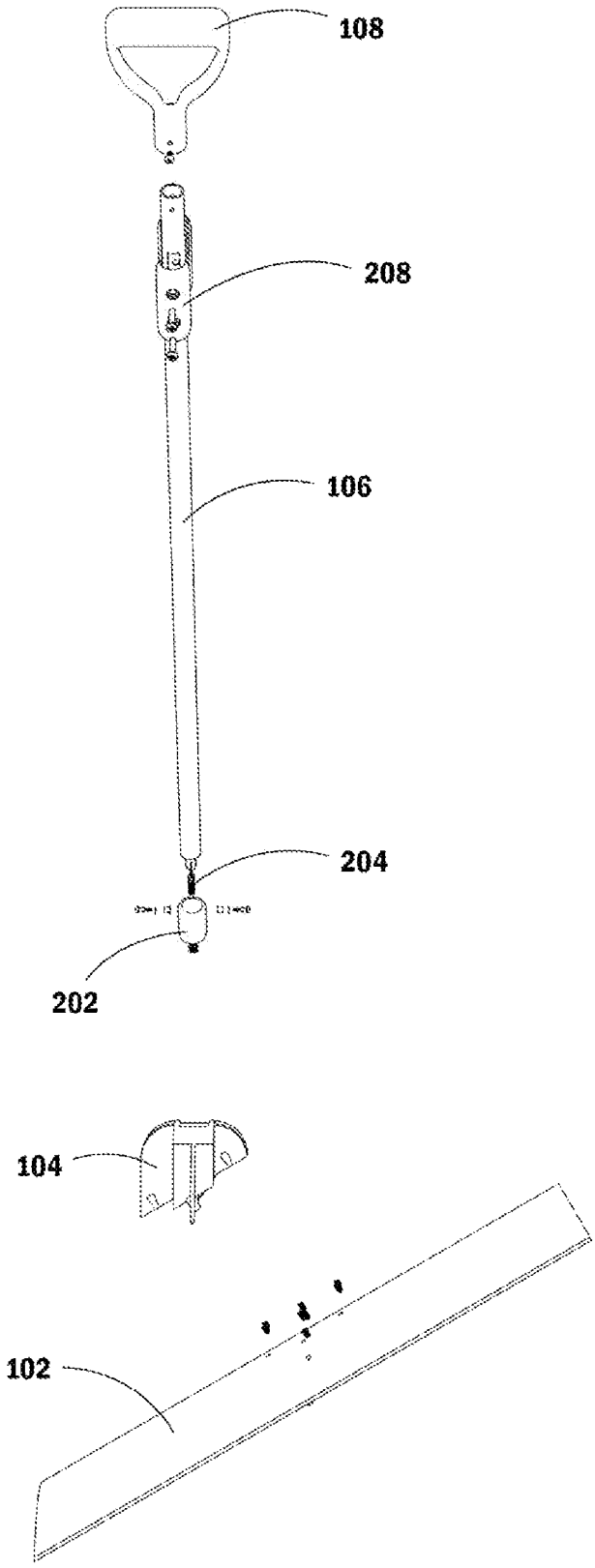
FIG. 9 is an exploded component view of an overflow resistant articulating pusher shovel, as contemplated by the present disclosure.
Figure 10:
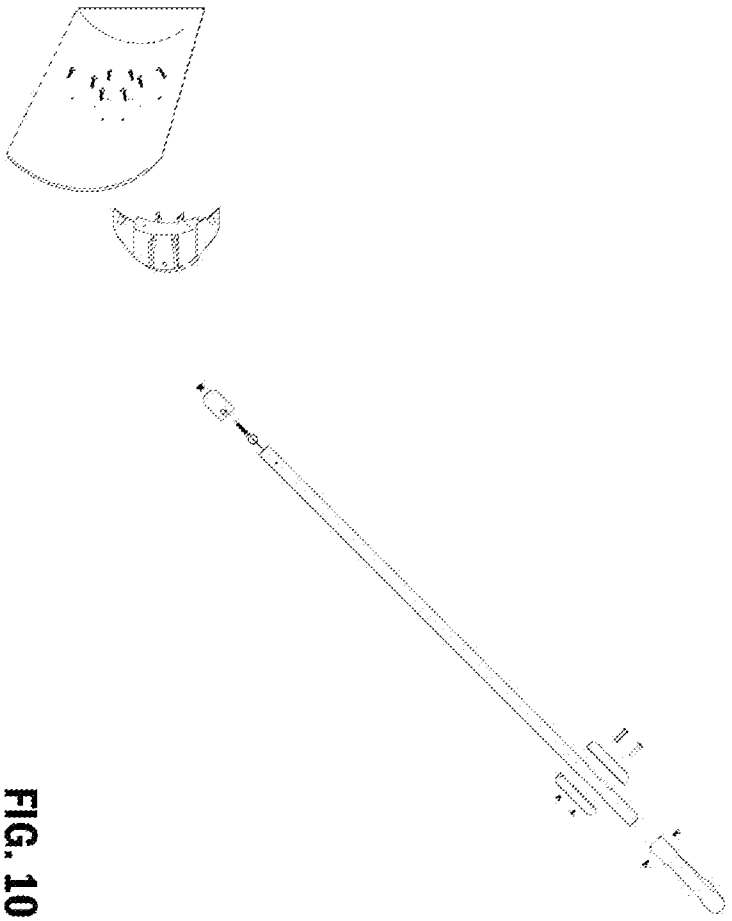
FIG. 10 is a left side exploded component view of an overflow resistant articulating pusher shovel, as contemplated by the present disclosure.
Figure 11:
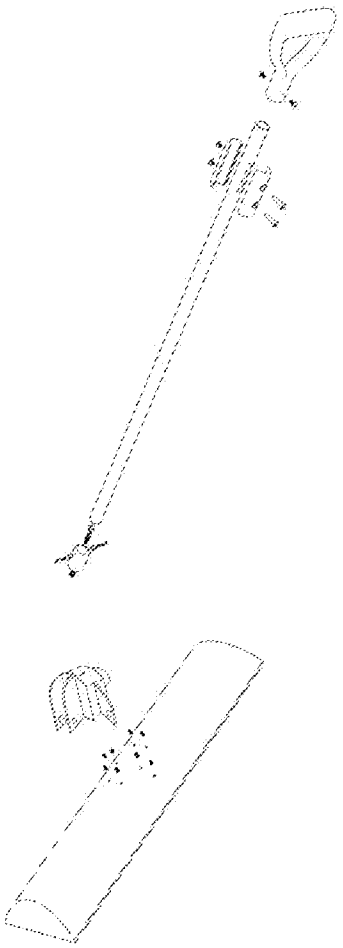
FIG. 11 is a right side exploded component view of an overflow resistant articulating pusher shovel, as contemplated by the present disclosure.
Figure 12:
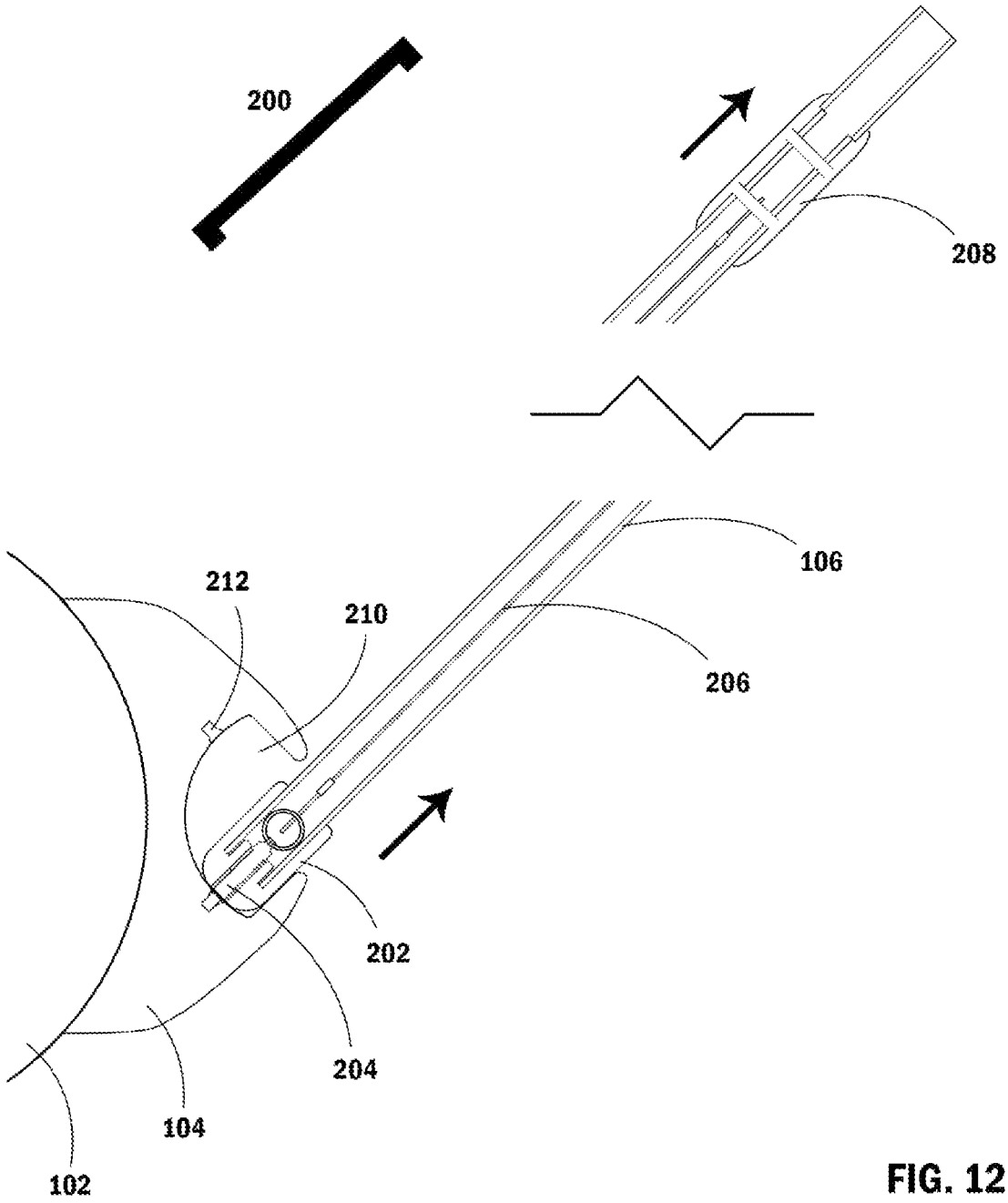
FIG. 12 is an exploded component view of an articulating mechanism of an overflow resistant articulating pusher shovel, as contemplated by the present disclosure.

Certain terminology is used in the following description for reference only and is not limiting. The words "front," "rear," "anterior," "posterior," "lateral," "medial," "upper," "lower," "outer," "inner," and "interior" refer to directions toward and away from, respectively, the geometric center of the invention, and designated parts thereof, in accordance with the present disclosure. Unless specifically set forth herein, the terms "a," "an," and "the" are not limited to one element, but instead should be read as meaning "at least one." The terminology includes the words noted above, derivatives thereof, and words of similar import.

The overflow resistant articulating pusher shovel may allow a user to clear material while preventing overflow from the shovel head and reducing the lifting strain placed upon the user. To reduce or prevent material overflow from the shovel head the device may comprise a shovel head endplate. To eliminate user lifting and straining under load the device may comprise an articulating head that allows a user to push materials in a desired direction instead of lifting that material. The overflow resistant articulating pusher shovel may further comprise a novel articulating mechanism for locking the shovel head into place but also allowing for the head to be articulated. Finally, the overflow resistant articulating pusher shovel may comprise any known advantages in the art, such as handles, shafts, and wear bars, so as to provide for additional ease of use and improved functionality.

The illustrations of FIGS. 1-13 illustrate an overflow resistant articulating pusher shovel, as contemplated by the present disclosure. The device may comprise, generally, a main body 100 and an articulating mechanism 200.

The main body 100 may comprise, generally, a head 102, an atlas 104, a shaft 106, and a handle 108. The head 102 may comprise any appropriate shovel head known in the art. In one embodiment the head 102 may comprise a generally rectangular shovel head designed for pushing material and having a semilunar cross-section. The longer edges of the head 102 may be thinned into a sharp angle to allow for scraping, while the center section of the head 102 may be thicker to provide for structural rigidity. One short end of the head 102 may further comprise an end plate 110, which is a plate closing off the opening of a short end and preventing material from overflowing the concavity of the head 102.

The handle 108 may comprise any appropriate handle allowing a user to control and manipulate the present device. The handle 108 may comprise, for example, a T-handle, a U-handle, or any other appropriate handle allowing for a user to push, pull, lift, turn, or otherwise manipulate the device.

The shaft 106 may comprise any appropriate shaft allowing for the extension of work applied by a user through the handle 108 over a desired distance. In one embodiment the shaft 106 may comprise a hollow cylinder or rod extending a desired length between the handle 108 and the head 102. The handle 108 may be attached to a proximal end of the shaft 106.

The atlas 104 may comprise any appropriate mechanism for connecting the shaft 106 to the head 102. In one embodiment the atlas 104 may comprise a shaft receiver, which may comprise an opening into which the shaft 106 may be inserted and mechanically attached. The atlas 104 may be attached to a distal end of the shaft 106. The atlas 104 may provide a transitional attachment by which work applied by a user into the handle 108 may be transferred from the shaft 106 to the head 102. In one embodiment the atlas 104 may offset the head 102 at an angle relative to the handle 108, so that force applied through the handle 108 causes the head 102 to push material to a side of the user.

The various components of the main body 100 may be attached to one another by any appropriate mechanism. By way of example, the various components of the main body 100 may be attached to each other by welding, bolting, screwing, inserting, melting, hooking, gluing, or otherwise adhering. In one embodiment a plurality of screws or bolts may be used to attach one component to another, as desired.

The articulating mechanism 200 may comprise, generally, a pivot 202, a locking pin 204, a cord 206, and a slide 208. The pivot 202 may comprise an end cap attached to the distal end of the shaft 106 and having an opening through its cap end. The atlas 104 may further comprise a pivot cavity 210 into which the pivot 202 fits. The pivot cavity 210 may comprise a semi-lunar cavity and the pivot 202 may articulate through a range of degrees within the pivot cavity 210.

The locking pin 204 may comprise a pin contained within the pivot 202 and extending distally outwards through the opening in the pivot 202 cap end. The locking pin 204 may further comprise a spring-loaded design so that it is pressed distally through the pivot 202 but can be retracted by a force pulling against it. The pivot cavity 210 may further comprise a plurality of pin receivers 212, which may comprise slots into which the projecting portion of the locking pin 204 may insert. By this design the locking pin 204 may insert into one of the plurality of pin receivers 212 and lock the relative angle of the shaft 106 to the atlas 104.

The slide 208 may comprise any appropriate slide mechanism. In one embodiment the slide 208 may comprise a handle wrapping around the shaft 106 and passing through the center of the shaft 106. The shaft 106 may comprise a pair of slit openings through which the slide 208 is installed, and the slide 208 may be moveable through a limited range within these slit openings. In other embodiments the slide 208 may comprise a bolt-action design, a lever-action design, or any other appropriate mechanism for pulling.

The cord 206 may comprise any appropriate cord for providing a mechanical connection between the slide 208 and the locking pin 204. The cord 206 may comprise, for example, synthetic rope, cabling, braided line, metal rod, or any other appropriate material. The mechanical connection of the cord 206 between the slide 208 and the locking pin 204 may cause the locking pin 204 to be retracted into the pivot 202 when the slide 208 is manipulated by a user.

This retracting of the locking pin 204 into the pivot 202 may then allow the pivot 202 to move freely within the pivot cavity 210. In this way the user may change the relative angle of the shaft 106 to the atlas 104. The spring-loaded design on the locking pin 204 may then allow the locking pin 204 to advance into a different one of the plurality of pin receivers 212 and again lock the shaft 106 to the atlas 104 at a chosen angle.

The various components of the articulating mechanism 200 may be attached to one another by any appropriate mechanism. By way of example, the various components of the articulating mechanism 200 may be attached to each other by welding, bolting, screwing, inserting, melting, hooking, gluing, or otherwise adhering. In one embodiment a plurality of screws or bolts may be used to attach one component to another, as desired.

In one embodiment the head 102 may further comprise a plurality of wear bars 112, which may comprise any appropriate blade reinforcement or extension. The wear bars 112 may be designed to wear down with use while protecting the head 102 from wear, and may comprise a replaceable component so that they can be replaced as desired.

Figure 13:
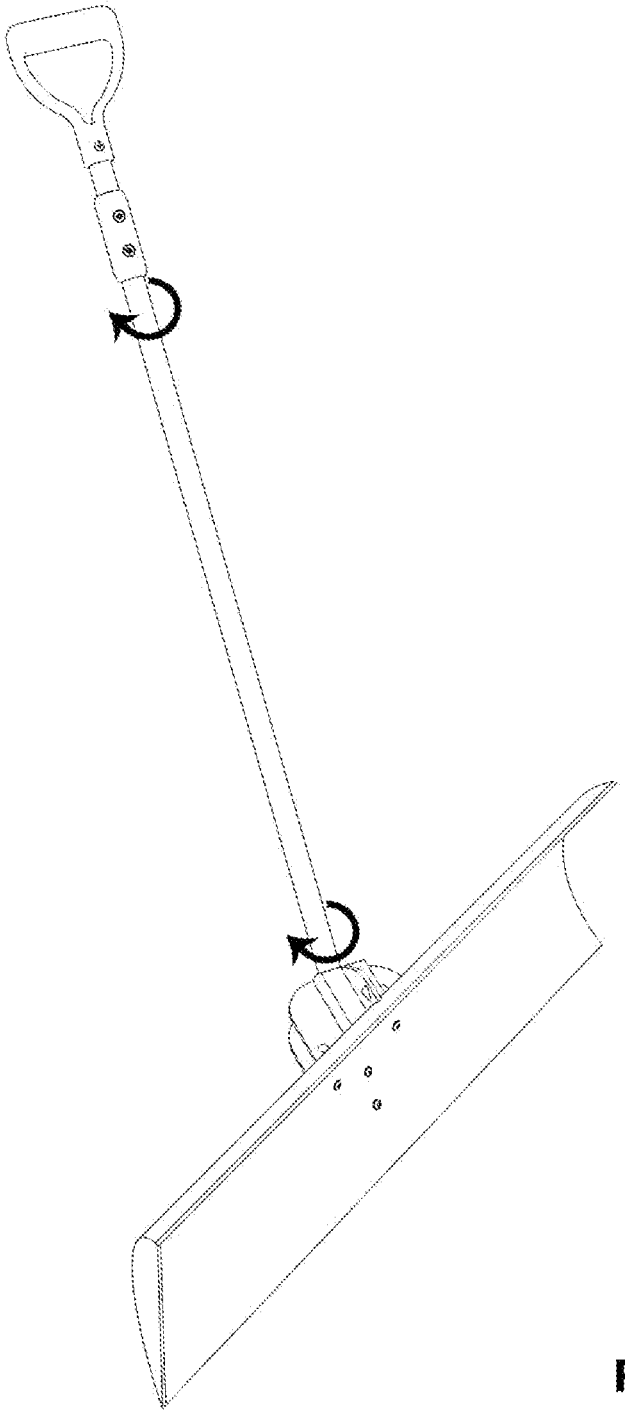
FIG. 13 is a front isometric perspective view of an overflow resistant articulating pusher shovel having a twist mechanism, as contemplated by the present disclosure.
Figure 13B:
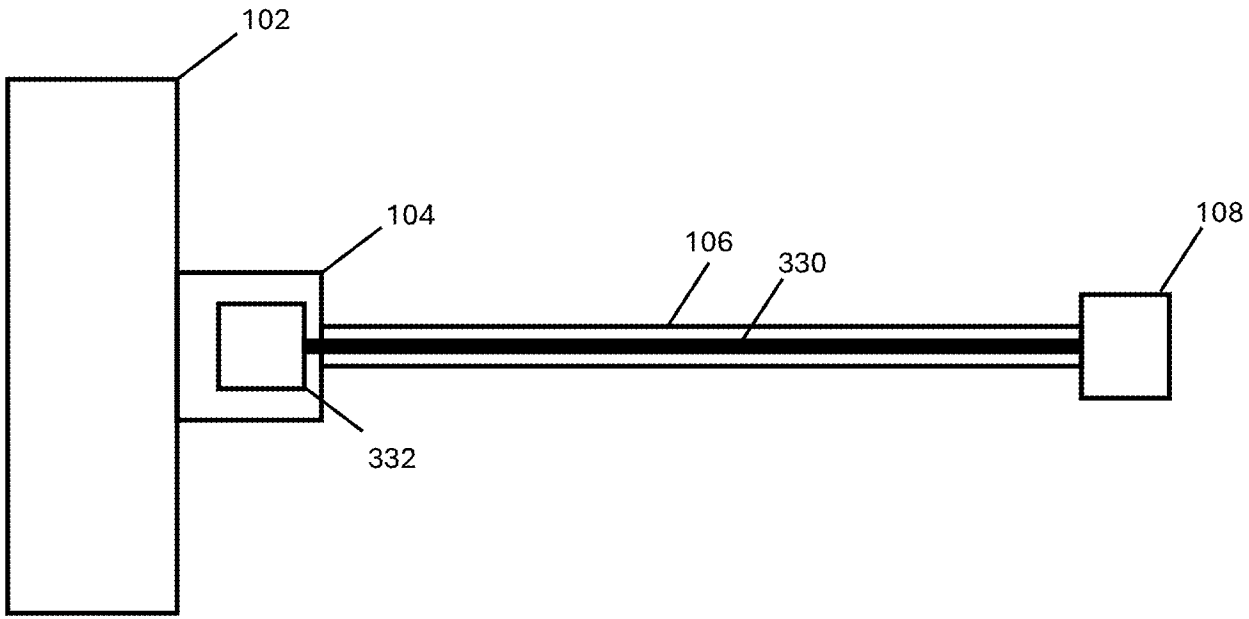
FIG. 13B is a schematic view of some features of an overflow resistant articulating pusher shovel having a twist mechanism, according to some examples.

In one embodiment the overflow resistant articulating pusher shovel may comprise a twisting mechanism that allows the relative angle of the head 102 to be articulated through a range of degrees relative to the shaft 106. Referring to FIG. 13B, the device may comprise a rotating handle 108 connected to a proximal end of a driveshaft 330 that passes through the shaft 106. The distal end of the driveshaft 330 may interface with a plurality of gears 332 located within the atlas 104. The twisting of the handle 108 relative to the shaft 106 would turn these gears 332 within the atlas 104, and the turning of these gears 332 within the atlas 104 may turn the head 102.

To begin using the device a user may first grasp the overflow resistant articulating pusher shovel by the handle 108 and along the shaft 106. The user may then push the device along the ground, thus causing the head 102 to displace material away from and to the side of the user. The end plate 100 may close one side of the head 102 so that material is only displaced by the user to the desired side. The user may then pull the slide 208 causing the locking pin 204 to release and allowing the shaft 106 to be repositioned within the pivot cavity 210 of the atlas 104. By this design the user may then reorient the head 102 relative to the shaft 106, and the user may then displace material away and to the opposite side of the prior configuration.

The overflow resistant articulating pusher shovel may be substantially constructed of any suitable material or combination of materials, but typically is constructed of a resilient material or combination of materials such that the device is resistant to damage as a result of compression, twisting, heating, or submersion in water. As an example, and without limiting the scope of the present invention, various exemplary embodiments of the overflow resistant articulating pusher shovel may be substantially constructed of one or more materials of steel, aluminum, brass, fiberglass, carbon fiber, plastic, acrylic, polycarbonate, polyester, nylon, denim, cotton, silicone, or combinations thereof. In some embodiments the various components of the device may be coated, lined, or otherwise insulated to prevent contamination of the device. In one embodiment the material of construction may vary from one component to the next within the system.

In one embodiment the overflow resistant articulating pusher shovel may comprise a resilient material of construction that either comprises a material having antimicrobial properties or comprises a layering of antimicrobial material or coating. Antimicrobial properties comprise the characteristic of being antibacterial, biocidal, microbicidal, antifungal, anti-viral, or other similar characteristics, and the oligodynamic effect, which is possessed by copper, brass, silver, gold, and several other metals and alloys, is one such characteristic. Copper and its alloys, in particular, have exceptional self-sanitizing effects. Silver also has this effect, and is less toxic to users than copper. Some materials, such as silver in its metallic form, may require the presence of moisture to activate the antimicrobial properties.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

I claim:

1. An overflow resistant articulating pusher shovel, comprising:

a head;

an atlas;

a shaft;

a handle;

a pivot;

a driveshaft; and a plurality of gears;

wherein said head comprises a shovel head;

wherein said shaft further comprises a proximal end and a distal end;

wherein said handle is attached to said proximal end of said shaft;

wherein said pivot is attached to said distal end of said shaft;

wherein said driveshaft is installed within said shaft;

wherein said plurality of gears are attached to a distal end of said driveshaft;

wherein said atlas further comprises a pivot cavity;

wherein said plurality of gears are installed within said pivot cavity; and wherein said atlas is attached to said head.

* * * * *